US009377245B2

(12) United States Patent
Holcomb et al.

(10) Patent No.: US 9,377,245 B2
(45) Date of Patent: Jun. 28, 2016

(54) HEAT EXCHANGER LIFE EXTENSION VIA IN-SITU RECONDITIONING

(71) Applicant: UT-Battelle, LLC, Oak Ridge, TN (US)

(72) Inventors: David E. Holcomb, Oak Ridge, TN (US); Govindarajan Muralidharan, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 599 days.

(21) Appl. No.: 13/833,357

(22) Filed: Mar. 15, 2013

(65) Prior Publication Data

US 2014/0261901 A1 Sep. 18, 2014

(51) Int. Cl.

| | |
|---|---|
| ***F28F 99/00*** | (2006.01) |
| ***C22F 1/00*** | (2006.01) |
| ***F28D 7/06*** | (2006.01) |
| ***C22F 1/10*** | (2006.01) |

(52) U.S. Cl.

CPC ... *F28D 7/06* (2013.01); *C22F 1/10* (2013.01); *C22F 1/00* (2013.01); *F28F 2225/02* (2013.01); *F28F 2245/00* (2013.01); *F28F 2265/00* (2013.01)

(58) Field of Classification Search

CPC ..... F28F 19/00; C22C 19/00; C22C 1/00; C22C 1/10

USPC ..... 148/555, 242

See application file for complete search history.

(56) References Cited

U.S. PATENT DOCUMENTS

| | | | |
|---|---|---|---|
| 2,684,299 | A | 7/1954 | Binder |
| 3,030,206 | A | 4/1962 | Buck, Jr. |
| 3,416,916 | A | 12/1968 | Herchenroeder |

(Continued)

FOREIGN PATENT DOCUMENTS

| | | | |
|---|---|---|---|
| CA | 706339 | | 3/1965 |
| CA | 1215255 | | 12/1986 |
| JP | 53120086 | A * | 10/1978 |

OTHER PUBLICATIONS

Bruemmer, Stephen M. and Gary S. Was, Microstructural and Microchemical Mechanisms Controlling Intergranular Stress Corrosion Cracking in Light-Water-Reactor Systems, Journal of Nuclear Materials, 1994, pp. 348-363, vol. 216.

(Continued)

*Primary Examiner* — Jessee Roe
*Assistant Examiner* — Jenny Wu
(74) *Attorney, Agent, or Firm* — Joseph A. Marasco

(57) ABSTRACT

A method of in-situ reconditioning a heat exchanger includes the steps of: providing an in-service heat exchanger comprising a precipitate-strengthened alloy wherein at least one mechanical property of the heat exchanger is degraded by coarsening of the precipitate, the in-service heat exchanger containing a molten salt working heat exchange fluid; deactivating the heat exchanger from service in-situ; in a solution-annealing step, in-situ heating the heat exchanger and molten salt working heat exchange fluid contained therein to a temperature and for a time period sufficient to dissolve the coarsened precipitate; in a quenching step, flowing the molten salt working heat-exchange fluid through the heat exchanger in-situ to cool the alloy and retain a supersaturated solid solution while preventing formation of large precipitates; and in an aging step, further varying the temperature of the flowing molten salt working heat-exchange fluid to re-precipitate the dissolved precipitate.

12 Claims, 2 Drawing Sheets

(56) References Cited

U.S. PATENT DOCUMENTS

| | | | | |
|---|---|---|---|---|
| 3,811,960 | A | 5/1974 | Perry et al. | |
| 3,917,463 | A | 11/1975 | Doi et al. | |
| 3,985,582 | A | 10/1976 | Bibring et al. | |
| 4,194,909 | A | 3/1980 | Ohmura et al. | |
| 4,476,091 | A | 10/1984 | Klarstrom | |
| 4,652,315 | A | 3/1987 | Igarashi et al. | |
| 4,740,354 | A | 4/1988 | Watanabe et al. | |
| 4,765,956 | A | 8/1988 | Smith et al. | |
| 4,820,359 | A | 4/1989 | Bevilacqua et al. | |
| 5,077,006 | A | 12/1991 | Culling | |
| 5,167,732 | A | 12/1992 | Naik | |
| 5,244,515 | A | 9/1993 | Miglin | |
| 5,330,590 | A | 7/1994 | Raj | |
| 5,527,402 | A * | 6/1996 | Ganesh | C21D 9/38 148/675 |
| 5,718,867 | A | 2/1998 | Nazmy et al. | |
| 5,888,316 | A | 3/1999 | Erickson | |
| 6,344,097 | B1 | 2/2002 | Limoges et al. | |
| 6,610,154 | B2 | 8/2003 | Limoges et al. | |
| 6,797,232 | B2 | 9/2004 | Speidel et al. | |
| 6,905,559 | B2 | 6/2005 | O'Hara et al. | |
| 6,908,518 | B2 | 6/2005 | Bouse et al. | |
| 7,011,721 | B2 | 3/2006 | Harris et al. | |
| 7,824,606 | B2 | 11/2010 | Heazle | |
| 8,147,749 | B2 | 4/2012 | Reynolds | |
| 8,313,591 | B2 | 11/2012 | Hirata et al. | |
| 2001/0040024 | A1 * | 11/2001 | Blanda, Jr. | C01C 3/022 165/134.1 |
| 2005/0056354 | A1 * | 3/2005 | Groh | C22F 1/10 148/675 |
| 2009/0044884 | A1 | 2/2009 | Toschi et al. | |
| 2009/0087338 | A1 | 4/2009 | Mitchell et al. | |
| 2009/0120629 | A1 * | 5/2009 | Ashe | B01J 19/0013 165/181 |
| 2009/0194266 | A1 | 8/2009 | Conrad et al. | |
| 2010/0008790 | A1 | 1/2010 | Reynolds | |
| 2010/0116383 | A1 | 5/2010 | Cloue et al. | |
| 2010/0303666 | A1 | 12/2010 | Bain et al. | |
| 2010/0303669 | A1 | 12/2010 | Pankiw et al. | |
| 2011/0272070 | A1 | 11/2011 | Jakobi et al. | |
| 2012/0279351 | A1 | 11/2012 | Gu et al. | |

OTHER PUBLICATIONS

Weitzel, P.S., Steam Generator for Advanced Ulta-Supercritical Power Plants 700 to 760C, Technical Paper, 2011, pp. 1-12.

Khan, T., The Development and Characterization of a High Performance Experimental Single Crystal Superalloy, pp. 145-155.

Freche, J.C., et al., Application of Powder Metallurgy to an Advanced-Temperature Nickel-Base Alloy, NASA-TN D-6560, pp. 1-22.

* cited by examiner

HEAT EXCHANGER LIFE EXTENSION VIA IN-SITU RECONDITIONING

STATEMENT REGARDING FEDERALLY SPONSORED RESEARCH

The United States Government has rights in this invention pursuant to contract no. DE-AC05-000R22725 between the United States Department of Energy and UT-Battelle, LLC.

CROSS-REFERENCE TO RELATED APPLICATIONS

This patent application is related to U.S. patent application Ser. No. 13/834,985, entitled "High Strength Alloys for High Temperature Service in Liquid-Salt Cooled Energy Systems" which is being filed on even date herewith, the entire disclosure of which is incorporated herein by reference.

BACKGROUND OF THE INVENTION

It is expedient to increase the efficiency of thermally based electricity generation in order to produce the maximum power while conserving resources. Any method of increasing said efficiency is inextricably linked to increasing the process temperature. The same fundamental association of higher temperatures with higher efficiency applies to all heat sources and power cycles. As the temperature of the process increases, the power cycle working fluid pressure concurrently increases. The high process pressure necessitates high strength containment materials.

The component under the most stress in nearly all thermally based power generation systems is generally the heat exchanger coupling between the low-pressure working fluid and the high-pressure power cycle fluid in indirect cycle systems, and between the combustion environment and the high-pressure power cycle fluid in direct cycle systems. Various temperatures and pressure differences are required across the heat exchanger regardless of the particular power cycle fluid selected (for example, molten salt, water, carbon dioxide, air, or helium) or heat source (for example, solar, nuclear, combustion). The high-temperature, high differential pressure heat exchangers for large power plants are large, expensive, and difficult to replace. Consequently, technologies for extending the life of such heat exchangers are of high value.

Conventional nickel-based super alloys are currently the leading structural material class for increased efficiency (high-temperature, high-pressure) power cycles. Conventional, well known precipitation strengthened nickel-based alloys exhibit both very high yield strengths and very high creep resistance. Although such alloys exhibit adequate oxidation resistance and resistance to combustion environments, they exhibit poor compatibility with both fluoride salts and alkali metals (the leading candidates for high temperature heat transport working fluids). Moreover, the microstructure—and consequently mechanical performance—of precipitation-strengthened alloys degrades at high temperatures over time necessitating component replacement or repair. Such degradation is accelerated by the application of external stress. Mitigation of degradation would be of high value.

BRIEF SUMMARY OF THE INVENTION

In accordance with one aspect of the present invention, the foregoing and other objects are achieved by a method of in-situ reconditioning a heat exchanger that includes the steps of: providing an in-service heat exchanger comprising a precipitate-strengthened alloy wherein at least one mechanical property of the heat exchanger is degraded by coarsening of the precipitate, the in-service heat exchanger containing a molten salt working heat exchange fluid; deactivating the heat exchanger from service in-situ; in a solution-annealing step, in-situ heating the heat exchanger and molten salt working heat exchange fluid contained therein to a temperature and for a time period sufficient to dissolve the coarsened precipitate; in a quenching step, flowing the molten salt working heat-exchange fluid through the heat exchanger in-situ to cool the alloy and retain a supersaturated solid solution while preventing formation of large precipitates; and in an aging step, further varying the temperature of the flowing molten salt working heat-exchange fluid to complete re-precipitate the dissolved precipitate.

Figure 1:
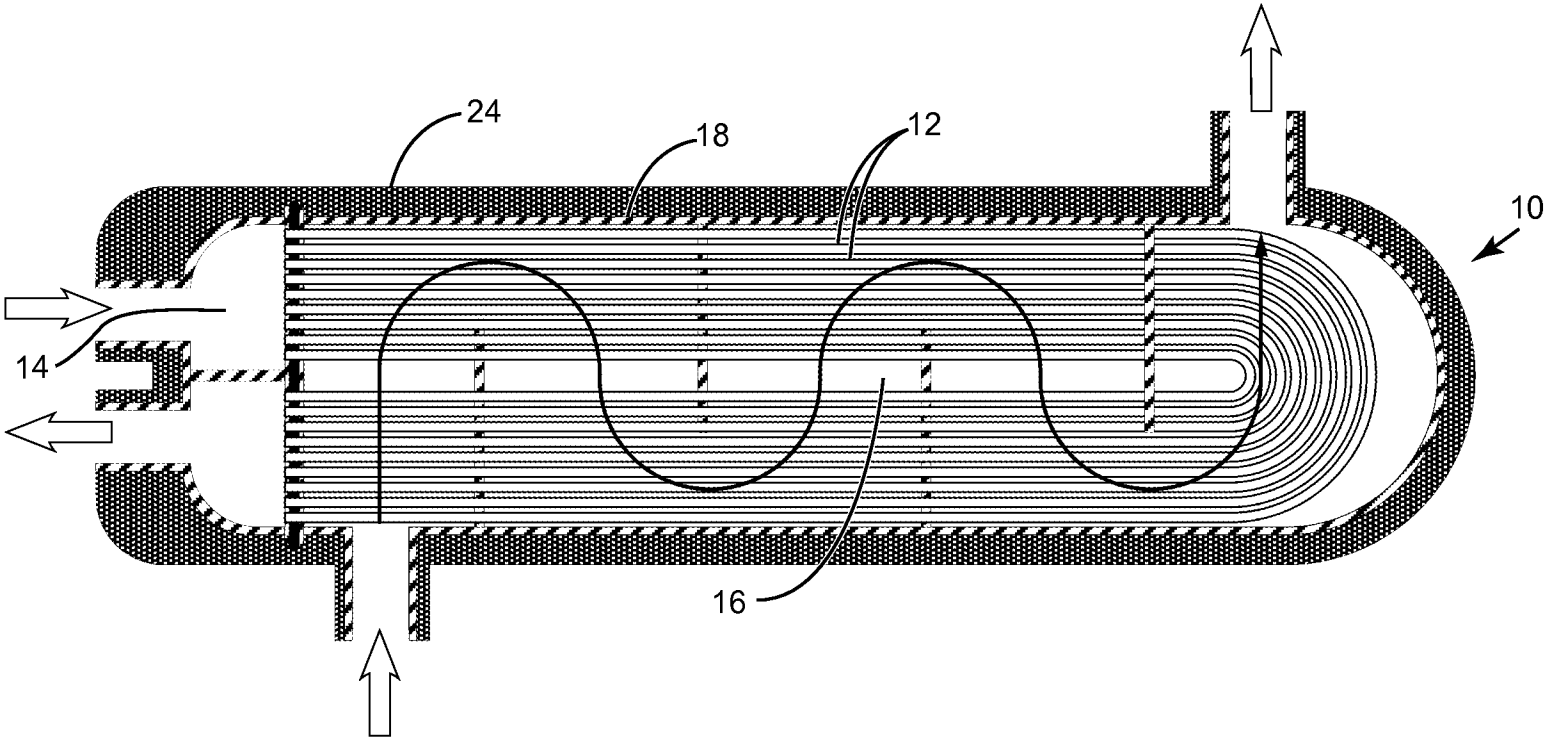
FIG. 1 is a schematic diagram of a heat exchanger system.

For a better understanding of the present invention, together with other and further objects, advantages and capabilities thereof, reference is made to the following disclosure and appended claims in connection with the above-described drawings.

DETAILED DESCRIPTION OF THE INVENTION

Of particular interest to this invention are precipitate-strengthened alloys. Some of the most suitable alloys are, for example, gamma-prime (γ')-strengthened, nickel based alloys for application in high differential pressure heat-exchangers. Such alloys derive their high strength and good creep resistance through a combination of solid solution strengthening and through the precipitation of small, finely dispersed coherent intermetallic strengthening precipitates, γ', which impede motion of dislocations. The compositions of these precipitates are typically of the form $Ni_3X$ where X can be Al, Ti, Nb, Ta or a combination of the foregoing. Alloys such as, for example, Nimonic 80A, IN 751, Nimonic 90, Waspaloy, Rene 41, Udimet 520, Udimet 720, and Alloy 617 are of interest to the invention.

The skilled artisan will recognize that various alloys containing other strengthening precipitates that behave in a similar manner to a γ' precipitate also are of interest to the invention.

Of particular interest to the invention are alloys that are essentially Fe- and Co-free, and low in Cr content, which are described in U.S. patent application No. filed on even date herewith by Govindarajan Muralidharan, David E. Holcomb, and Dane F. Wilson, entitled "Creep-Resistant, Cobalt-Free Alloys for High Temperature, Liquid-Salt Heat Exchanger Systems", the entirety of which is incorporated herein by reference.

The γ' phase is typically produced through a multi-step heat-treatment process. The skilled artisan will understand that the steps described hereinbelow can be tailored to a specific alloy, component geometry, and application requirements for strength, hardness, and/or other durability aspects.

The first step is a solution-annealing heat-treatment wherein the alloy is heated to a temperature above the solvus temperature of the specific strengthening precipitate. Solvus temperatures of γ' precipitates are typically in the range of 870-1100° C. depending on the composition of the alloy, hence requiring a maximum solution annealing temperature of no more than about 1150° C.

The solution annealing treatment is followed by a quenching step in which the alloy is rapidly cooled to a temperature at or below a working temperature, generally in the range of room temperature to 600° C. The effect of quenching is to is to retain the supersaturated solid solution and prevent unintentional growth of large precipitates at high temperatures during cooling.

A third step is a single or multi-step aging process, which promotes the growth of small strengthening precipitate microstructures. Aging is generally carried out in the range of 600-900° C. which results in the formation of fine intermetallic precipitates that provide the alloy with the required strength and creep resistance. Aging is generally carried out according to a time-temperature transformation curve that is specific to the alloy. Higher temperatures are used to promote faster precipitation, but less precipitate will form at higher temperatures. Aging can include in-service hardening.

The microstructure of precipitation-strengthened alloys degrades at temperature over time due to the coarsening (increase in the average size and interparticle spacing) of the strengthening γ' phase, resulting in loss of yield and creep strength, thus necessitating component replacement or repair. Degradation is accelerated by mechanical stress. Degradation can be reversed by reconditioning the alloy; reconditioning is accomplished by repeating the multi-step heat-treatment process described herein, restoring initial precipitation-strengthening in the alloy. Heretofore, reconditioning has been carried out ex-situ; a component is removed from a service installation and taken to a heat treatment facility.

The invention comprises an in-situ reconditioning method to dissolve the γ' precipitate and subsequent re-precipitation to regain the initial strength and creep resistance. The method can be repeated periodically over the lifetime of the component, thus prolonging life and avoiding replacement cost. Reconditioning is also known as rejuvenation with respect to the process used in the present invention.

The present invention is more preferably applicable to components fabricated from γ' strengthened alloys and other strengthening precipitates that can be solution-annealed at temperatures of 1200° C. or below. Other precipitation strengthening phases, such as carbide strengthening, require solution-annealing heat-treatment at temperatures above 1200° C. to completely dissolve the precipitate phase and may prove to be relatively impractical to effectively implement in-situ due to (1) the difficulty of heating a component to such high temperatures and (2) the potential heat damage to other adjacent components and materials.

In accordance with examples of the present invention, the lower temperature required for dissolution and re-precipitation of the γ' phase makes it quite feasible for periodical, in-situ, reconditioning of various components. For example during power-plant maintenance outages, power generation components can be reconditioned without removal from service installations.

FIG. 1 shows a typical tube-in-shell heat exchanger 10, with a heat exchange tube 12 (normally an array comprising a multiplicity of tubes) containing a high-pressure power cycle fluid 14. A low-pressure working fluid 16 outside the tube 12 is contained by the heat exchanger shell 18. Arrows indicate flows of heat exchange fluids 14, 16 during normal operation.

Examples of a working fluid 16 suitable for carrying out the method are various molten salt heat exchange compositions. One example is the low melt eutectic of KF—$ZrF_4$; analysis of phase behavior suggests the salt to be between 40 and 60 mole % KF with the balance $ZrF_4$. An example of a favorable candidate salt composition is contemplated to be 53 mole % KF and 47 mole % $ZrF_4$. Another example salt composition is NaF—$ZrF_4$. Oak Ridge National laboratory Publication No. ORNL/TM-2006/69 by D. F. Williams, entitled "Assessment of Molten Salt Coolants for the NGNP/NHI Heat-Transfer Loop", provides an assessment of the characteristics of various candidate salt compositions.

In accordance with examples of the present invention, a heating jacket 24 is disposed around the outside of the heat exchanger shell 18. The heating jacket 24 can be comprised of resistance heaters, but the skilled artisan will recognize that various other, well known heating means such as fossil fuel combustion or induction could be used. The skilled artisan with further recognize that heating jackets are commonly used in liquid-salt-type heat exchangers in order to prevent solidification of working fluid during filling, thus the heat exchanger design does not generally need to be altered to allow the in-situ heat treatment.

The heat exchanger 10 is deactivated from service, but remains in-situ. The working fluid 16 can be the reconditioning fluid. Circulation of both the power cycle fluid 14 and the working fluid 16 are stopped for the reconditioning process. The power cycle fluid 14 can be removed from the tube 12 during the reconditioning process to prevent excess pressure, or the pressure can be lowered by a pressure relief valve. Auxiliary heating of the working fluid 16 circuit outside the heat exchanger 10 may be necessary to maintain the fluidity thereof.

In a first, solution-annealing step, the heating jacket 24 is activated in order to elevate the temperature of the heat exchanger 10 to a temperature that is above the solvus temperature of the composition of the alloy of which the heat exchanger 10 is comprised. The static working fluid 16 (or another reconditioning fluid) assists in transferring the heat to all parts of the heat exchanger 10, including the heat exchange tube 12, thus solution-annealing all the parts of the heat exchanger 10 in-situ. The elevated temperature is maintained for a sufficient duration to completely solution-anneal the heat exchanger 10 as described hereinabove, effectively dissolving essentially all of the γ' precipitate phase. The duration will depend on the alloy composition, solution-annealing temperature, and cross-section thickness.

In a second, quenching step, after solution-annealing is complete, the heating jacket 24 is deactivated and flow of the working fluid 16 is rapidly restarted to quench the alloy of the heat exchanger 10 to a temperature below the working temperature of the heat exchanger 10 and preferably to the lowest temperature at which the working fluid will remain sufficiently fluid to flow. Quenching allows retention of the elements required for the formation of the precipitates within the supersaturated solid solution and prevents unintentional growth of large precipitates at high temperatures during cooling.

A third aging step, following the quenching step, completes the re-precipitation of the γ' precipitate phase. The temperature is raised from the quenching temperature, preferably to a maximum temperature no greater than the normal operating temperature of the heat-exchanger 10, in order to facilitate precipitation of the desired microstructures. Aging of the heat exchanger alloy can be carried out in-service by monitoring and varying the flow and temperature of heat exchange fluids 14, 16 through the heat exchanger to achieve desired aging temperatures and times. The heating jacket 24 and/or auxiliary heating may also be used in the aging process. The skilled artisan will recognize that aging can comprise one or a plurality of steps. The alloy of the heat exchanger 10 is thus reconditioned in-situ. The pressure of the power cycle fluid 14 must be controlled until the heat exchanger alloy strength is sufficiently restored to withstand high pressure.

The in-situ heat-treatment process can be repeated throughout the facility lifetime greatly extending the heat exchanger lifetime. A possibility of an eventual limitation to repeating the in-situ heat treatment may be caused by a potential loss of aluminum in the alloy through preferential dissolution of aluminum from the alloy into the liquid salt. The Gibbs free energy of $AlF_3$ is sufficiently low that it will rapidly dissolve into fluoride salts. Hence, sufficient excess aluminum or diffusion barriers are recommended in the initial composition so that many years of solid-state diffusion will be required to deplete the aluminum from the alloy. Titanium loss may also need to be monitored and/or controlled in a similar fashion.

Example

A heat exchanger is fabricated using Alloy 8 described in the patent application referenced hereinabove, expressed in weight %:1.23 Al-6.56 Cr-0.74 Mn-11.78 Mo-2.43 Ti-0.01 Nb-0.56 W-0.031 C-0.0003 N-balance Ni. The heat exchanger is installed in a system where it is used in service using a molten salt working heat exchange fluid comprising about 53 mole % KF and about 47 mole % $ZrF_4$. After remaining in service for a sufficient time to render the heat exchanger in need of reconditioning, the heat exchanger is taken out of service and isolated from the system by closing appropriate valves and shutting off coolant pumps, with the molten salt remaining inside the heat exchanger.

Pressure is lowered on the high pressure side of the heat exchanger by opening a pressure relief valve. By energizing a heating jacket around the heat exchanger, the temperature of the heat exchanger (and the molten salt contained therein) is raised to 1121° C. and held for 4 hours to solution-anneal the alloy of the heat exchanger.

Subsequently, the heating jacket is de-energized. Valves are reopened and coolant pumps are restarted, causing molten salt working heat exchange fluid to flow, reducing the temperature of the heat exchanger to 550° C. as quickly as is reasonably feasible in order to quench the alloy of the heat exchanger.

Aging of the heat exchanger alloy is carried out in-service by monitoring and varying the flow and temperature of heat exchange fluid through the heat exchanger (including re-energizing the heating jacket if required) to achieve desired aging temperatures and times. The heat exchanger is thus reconditioned.

Pressure is restored on the high pressure side of the heat exchanger by closing the pressure relief valve, and the heat exchanger is returned to service.

Figure 2:
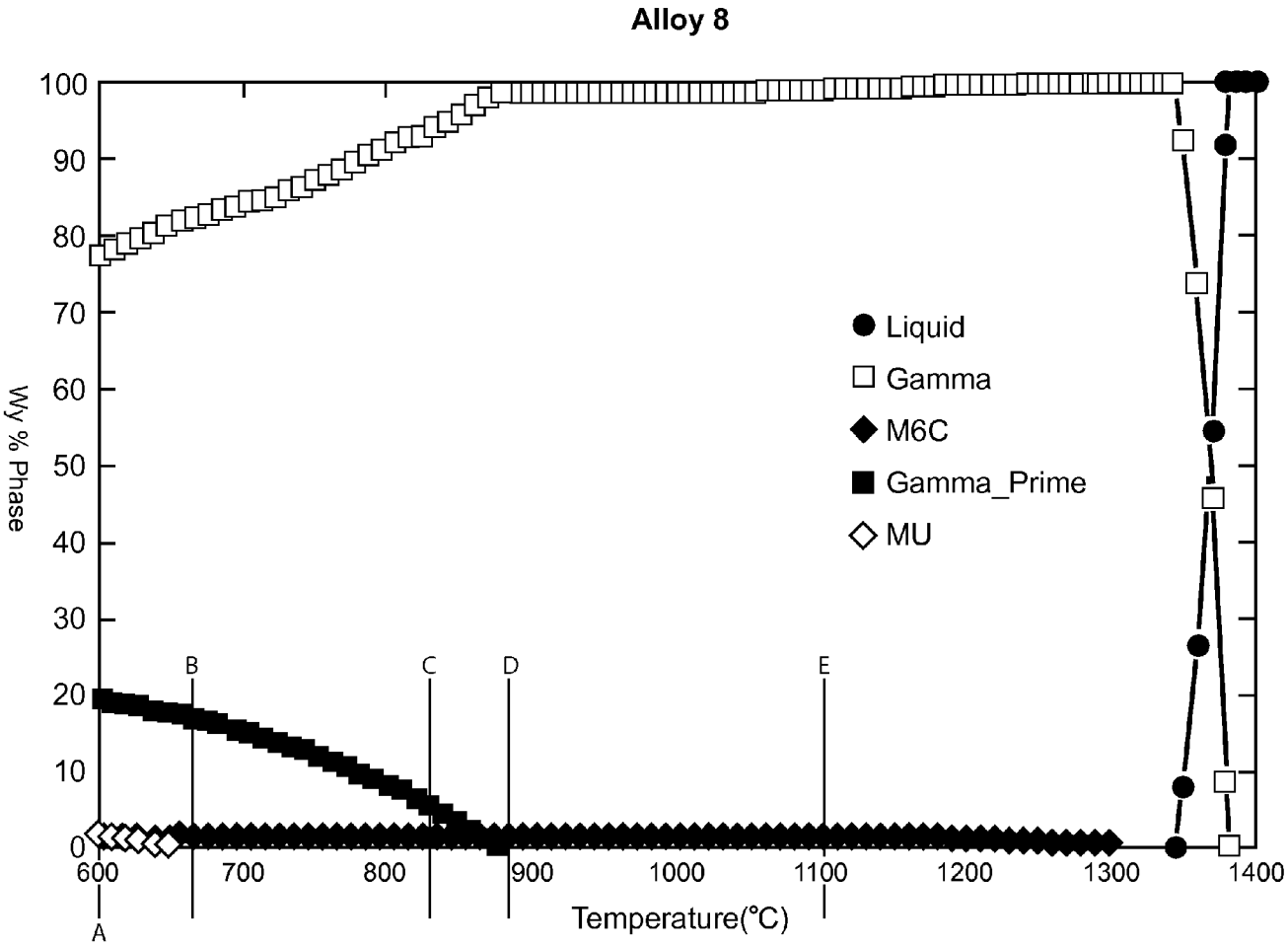
FIG. 2 is a graph showing phase equilibria for Alloy 8 as a function of temperature (nitrogen and boron are not included in the calculations).

Referring to FIG. 2, For Alloy 8, The working temperature range of a typical molten salt working heat exchange fluid can be temperature B, about 650° C., to temperature C, about 850° C. The first, solution-annealing step, can be carried out above the solvus temperature D, which is about 880° C. Temperature E, about 1150° C. is a practical maximum above which sacrifices in energy usage and other deleterious effects may occur. In the second, quenching step, the temperature can be lowered below temperature A, which is about 600° C. The lower limit is the temperature at which the molten salt working heat exchange fluid freezes or becomes deleteriously viscous. Aging, the third step, can be carried out by heat-treatment at various temperatures between temperature A and temperature C, and preferably at a maximum temperature no greater than the normal operating temperature of the heat-exchanger.

While there has been shown and described what are at present considered to be examples of the invention, it will be obvious to those skilled in the art that various changes and modifications can be prepared therein without departing from the scope of the inventions defined by the appended claims.

What is claimed is:

1. A method of in-situ reconditioning a heat exchanger comprising the steps of:

a. providing an in-service heat exchanger comprising a precipitate-strengthened alloy wherein at least one mechanical property of said heat exchanger is degraded by coarsening of said precipitate, said in-service heat exchanger containing a molten salt working heat exchange fluid;

b. deactivating said heat exchanger from service in-situ;

c. in a solution-annealing step, in-situ heating said heat exchanger and molten salt working heat exchange fluid contained therein to a temperature and for a time period sufficient to dissolve said coarsened precipitate;

d. in a quenching step, flowing said molten salt working heat-exchange fluid through said heat exchanger in-situ to cool said alloy and retain a supersaturated solid solution; and e. in an aging step, further varying the temperature of said flowing molten salt working heat-exchange fluid to re-precipitate said dissolved precipitate.

2. A method in accordance with claim 1 wherein said precipitate is a gamma-prime (γ') precipitate.

3. A method in accordance with claim 1 wherein said solution-annealing step is carried out at a temperature in the range of 870° C. to 1150° C.

4. A method in accordance with claim 1 wherein said solution-annealing step is carried out by energizing a heating jacket.

5. A method in accordance with claim 1 wherein said quenching step is carried out at a temperature in the range of no lower than the lowest temperature at which said working fluid will remain sufficiently fluid to flow to a temperature below a working temperature of said heat exchanger.

6. A method in accordance with claim 5 wherein said temperature range is 550° C. to 650° C.

7. A method in accordance with claim 1 wherein said aging step is carried out at a temperature in the range of 600° C. to 850° C.

8. A method in accordance with claim 1 wherein said aging step is carried out at a maximum temperature no greater than a normal operating temperature of said heat-exchanger.

9. A method in accordance with claim 1 wherein said aging step further comprises flowing a power cycle fluid through said heat exchanger.

10. A method in accordance with claim 1 wherein said aging step further comprises energizing a heating jacket.

11. A method in accordance with claim 1 further comprising an additional, subsequent step of:

f. reactivating said heat exchanger to service.

12. A method in accordance with claim 1 further comprising an additional step of, after said deactivating step and prior to said solution-annealing step, draining a power cycle heat-exchange fluid from said heat exchanger.

* * * * *